US012680401B2

(12) United States Patent
Wang et al.

(10) Patent No.: US 12,680,401 B2
(45) Date of Patent: Jul. 14, 2026

(54) GENERATING DOWNHOLE MOTOR TORQUE AND RPM OF A DOWNHOLE MOTOR WITH A DRILLING FLUID HAVING A COMPRESSIBLE PORTION

(71) Applicant: Schlumberger Technology Corporation, Sugar Land, TX (US)

(72) Inventors: Yaou Wang, Sugar Land, TX (US); Yong Chang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 139 days.

(21) Appl. No.: 18/760,190

(22) Filed: Jul. 1, 2024

(65) Prior Publication Data

US 2026/0002419 A1 Jan. 1, 2026

(51) Int. Cl.
*E21B 21/08* (2006.01)
*E21B 47/12* (2012.01)

(52) U.S. Cl.
CPC ..... *E21B 21/08* (2013.01); *E21B 47/12* (2013.01)

(58) Field of Classification Search
CPC ..... E21B 21/08; E21B 47/12; E21B 47/06
See application file for complete search history.

(56) References Cited

U.S. PATENT DOCUMENTS 6,176,323 B1 * 1/2001 Weirich ..... E21B 44/005 175/40
10,287,856 B2 * 5/2019 Filippov ..... G05D 7/0635
2017/0146007 A1 * 5/2017 Robison ..... E21B 43/127

* cited by examiner

*Primary Examiner* — Catherine Loikith
(74) *Attorney, Agent, or Firm* — Kyle R. Miiller

(57) ABSTRACT

A downhole motor control system may identify a downhole compressible density of a drilling fluid using a downhole temperature and a downhole pressure of the drilling fluid, the drilling fluid including an incompressible portion and a compressible portion, the drilling fluid flowing downhole with a downhole compressible flow component and an incompressible flow component. A downhole motor control system may determine the downhole compressible flow component using the downhole compressible density, a surface compressible density of the compressible portion at a surface location, and a surface compressible flow component of the compressible portion at the surface location. A downhole motor control system may identify a downhole compressible fraction of the drilling fluid based on the downhole compressible flow component and the incompressible flow component. A downhole motor control system may generate a composite flow rate of the drilling fluid based on the incompressible flow component and the downhole compressible fraction.

9 Claims, 7 Drawing Sheets

GENERATING DOWNHOLE MOTOR TORQUE AND RPM OF A DOWNHOLE MOTOR WITH A DRILLING FLUID HAVING A COMPRESSIBLE PORTION

BACKGROUND OF THE DISCLOSURE

Exploring, drilling, and completing hydrocarbon and other wells are generally complicated, time consuming and ultimately very expensive endeavors. As such, tremendous emphasis is often placed on well applications and monitoring that rely heavily on periodic intervention for sake of well management. For example, various wireline, tractoring, coiled tubing (CT) and other types of interventions are often periodically introduced to the well throughout a life of the well. These interventions may be aimed at acquiring well condition information, directing a well cleanout, installation of downhole devices or a variety of other applications.

By way of example, CT supported applications utilize an injector positioned over pressure control equipment (PCE) that may include a head with pressure control valves, chokes and other features that is secured to a blowout preventor (BOP) stack at a well head leading to the well below surface. During interventions, a downhole motor may provide torque and/or generate power for downhole operations.

SUMMARY

In some aspects, the techniques described herein relate to a method for identifying an output of a downhole motor. A downhole motor control system identifies a downhole compressible density of a drilling fluid using a downhole temperature and a downhole pressure of the drilling fluid. The drilling fluid includes an incompressible portion and a compressible portion. The drilling fluid flows downhole with a downhole compressible flow component and an incompressible flow component. The downhole motor control system determines the downhole compressible flow component using the downhole compressible density, a surface compressible density of the compressible portion at a surface location, and a surface compressible flow component of the compressible portion at the surface location. The downhole motor control system identifies a downhole compressible fraction of the drilling fluid based on the downhole compressible flow component and the incompressible flow component. The downhole motor control system generates a composite flow rate of the drilling fluid based on the incompressible flow component and the downhole compressible fraction.

In some aspects, the techniques described herein relate to a method for identifying an output of a downhole motor. The downhole motor control system, at a surface location, combines an incompressible fluid and a compressible fluid, resulting in a drilling fluid having an incompressible portion including the incompressible fluid and a compressible portion including the compressible fluid. The compressible portion has a surface compressible density and a surface compressible flow component. The downhole motor control system measures a downhole temperature and a downhole pressure of the drilling fluid. The downhole motor control system calculates a downhole compressible fraction of the drilling fluid using the downhole temperature and the downhole pressure. The downhole motor control system determines a motor torque and a rotational rate of a downhole motor using the downhole compressible fraction of the drilling fluid. When the motor torque or the rotational rate are outside of a threshold range, the downhole motor control system adjusts the incompressible portion or the compressible portion of the drilling fluid.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
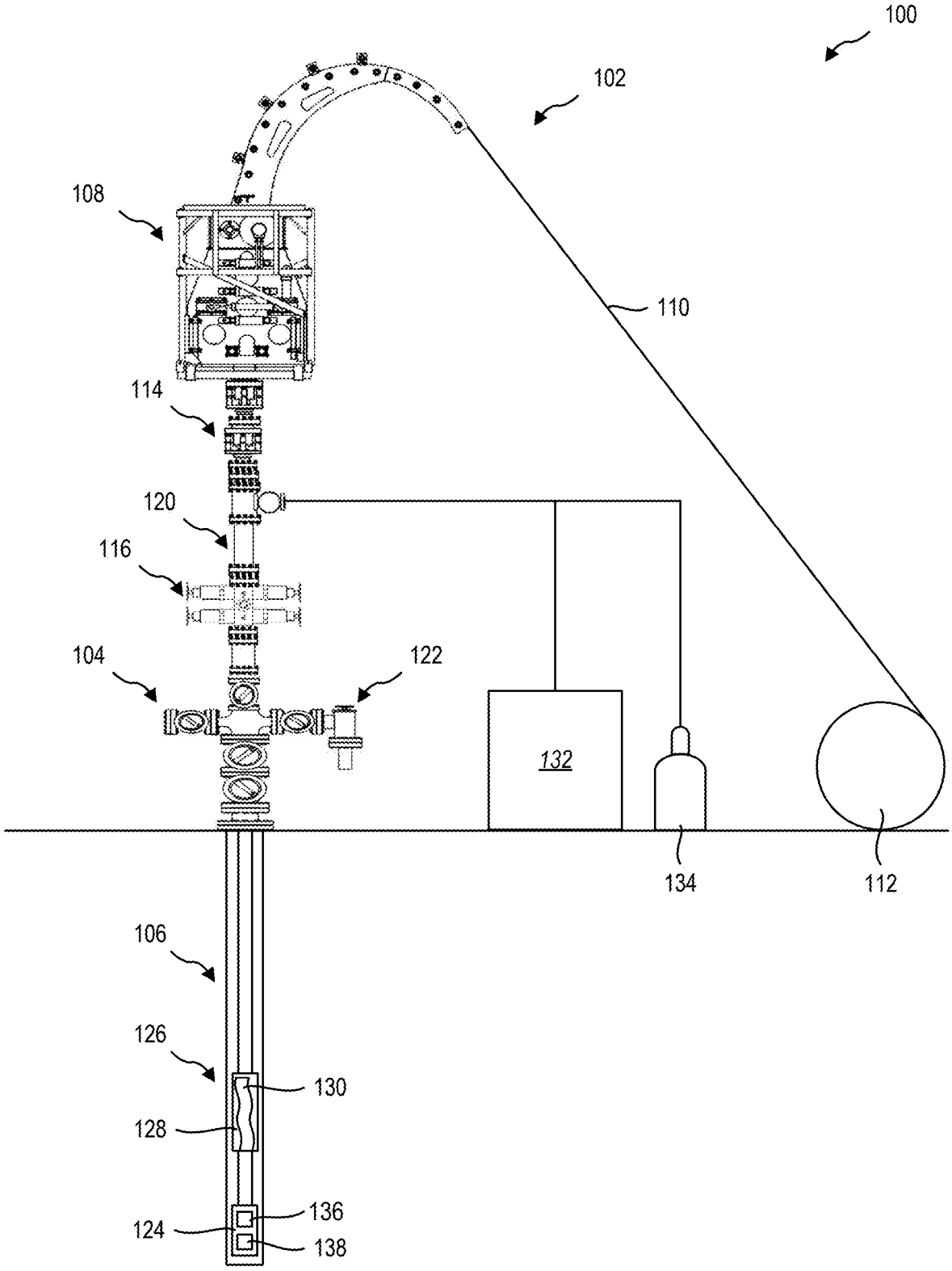
FIG. 1 is a representation of an intervention system, according to at least one embodiment of the present disclosure.

This disclosure generally relates to devices, systems, and methods for monitoring the output of a downhole positive displacement motor in a drilling system having a drilling fluid including a mixture of compressible and incompressible fluids. In certain situations, a compressible fluid is added to the drilling fluid to adjust the relative pressure between the formation and the wellbore. In an overbalanced wellbore, fluid from the formation may infiltrate the wellbore. In an underbalanced wellbore, drilling fluid from the wellbore may penetrate the formation. In an overbalanced wellbore, the drilling operator may mix a compressible fluid into the drilling fluid to adjust the fluid pressure to generate an underbalanced drilling environment. This may result in the drilling fluid including an incompressible component and a compressible component. The incompressible component may include any incompressible fluid, such as water, salt water (e.g., ocean water, engineered salt water), oil, water-based mud, oil-based mud, any other incompressible fluid, and combinations thereof.

The compressible component may be any compressible fluid. For example, the compressible fluid may include a gas, such as nitrogen gas ($N_2$), carbon dioxide gas, atmospheric air (including a mix of nitrogen, oxygen, argon, carbon dioxide, and other trace gasses), any other gas, and combinations thereof. Based on the pressure and temperature at depth in the wellbore (e.g., at the mud motor or other rotary device), the downhole drilling fluid flow rate may be different than the surface drilling fluid flow rate due to the compressibility of the compressible gas. As a result of the difference between the downhole drilling fluid flow rate and the surface drilling fluid flow rate, the operation of a downhole motor (such as a positive displacement motor) may be different downhole than at the surface using surface measured conditions. This may result in improper operation of the downhole motor when the operation of the downhole motor is based on the flow rate as measured at a surface location. For example, this may result in stall of the mud motor, underpowered operation of the mud motor, or a difference between the anticipated rotational rate (e.g., rotations per minute (RPM) and the anticipated motor torque and the actual RPM or motor torque.

In accordance with at least one embodiment of the present disclosure, a downhole motor control system may generate a composite flow rate for the drilling fluid at the downhole motor. The composite flow rate may be based on the incompressible portion of the flow rate and a downhole compressible portion based on the conditions at the downhole motor. Using the composite flow rate, the downhole motor control system may determine the RPM and the motor torque. The composite flow rate may result in increased accuracy and/or representative of the determined RPM and motor torque. The various flow rates and portions of flow rates discussed herein may be any type of flow rate. For example, the flow rates discussed herein may be volumetric flow rates (e.g., gallons per minute (GPM), cubic feet per second (CFS), cubic meters per second (CMS)). In some examples, the flow rates may be mass flow rates.

In some embodiments, the downhole motor control system may adjust the parameters of the drilling fluid when the determined RPM and motor torque are outside of a threshold range. This may facilitate increased control over the downhole motor.

FIG. 1 is a representation of an intervention system 100, according to at least one embodiment of the present disclosure. The intervention system 100 in the surface equipment zone may include a coiled tubing (CT) system 102 secured to a wellhead 104 connected to a well 106. The coiled tubing system 102 may perform an intervention in a well 106. To perform the intervention, an injection sub 108 may guide coiled tubing 110 from a coil 112 through the coiled tubing system 102. While the intervention system 100 illustrated includes a CT system, it should be understood that the intervention system 100 may include any type of intervention system, such as a wireline system or a tractoring system, with their associated surface components.

The coiled tubing system 102 may include a stripper 114 below the injection sub 108 to contain and remove fluid from the intervention. Pressure control equipment 116 (PCE) is located below the stripper 114. A riser 120 may be located between the PCE 116 and the stripper 114 to raise the height of the connection between the injection sub 108 and the rest of the coiled tubing system 102. The PCE 116 may include one or more rams to shear the coiled tubing 110 in the coiled tubing system 102 and seal the coiled tubing system 102 from ingress of fluids from the well 106. The wellhead 104 may include a production valve 122. The production valve 122 may control and direct production fluid from the well 106 to storage, transportation, and/or processing.

During an intervention, the coiled tubing 110 may be inserted into the well 106. A CT bottom hole assembly (BHA) 124 may include one or more downhole tools to perform a particular task. Taks performed during an intervention may include, but are not limited to, well conditioning, well cleaning, well stimulation, water or gas conformance, fracking, casing perforation, surveying and other condition monitoring, tool retrieval, and combinations thereof.

The intervention system 100 in the BHA 124 may include a downhole motor 126. The downhole motor 126 includes a stator 128 and a rotor 130. Fluid flow through the coiled tubing 110 in the well 106 may cause the rotor 130 to rotate within the stator 128. Rotation of the rotor 130 may generate power for the operation of one or more tools at the BHA 124. For example, the rotor 130 may generate mechanical power as torque (e.g., motor torque) usable by the BHA 124 (such as a bit or other rotary tool) based on a connection with the rotor 130. In some examples, the rotor 130 may be part of or connected to an electrical power generator, and the electrical power may be used to power one or more of the downhole tools in the BHA 124. The rotation of the rotor 130 may be directly associated with the motor torque and/or the electrical power generation.

The rotor 130 may be based on the fluid flow rate of the drilling fluid passed through the downhole motor 126. For example, a higher fluid flow rate may be associated with a higher RPM and/or a higher motor torque, and a lower fluid flow rate may be associated with a lower RPM and/or a lower motor torque. In some embodiments, when the fluid flow rate is too high, the downhole motor 126 may stall, with fluid passing directly through the downhole motor 126 without rotating the rotor 130 or with a reduced rotation of the rotor 130. Thus, to operate the BHA 124, the fluid flow rate through the downhole motor 126 may be within a threshold range, with a low flow rate threshold associated with a low threshold RPM (e.g., low rotational rate threshold) and/or torque (e.g., low motor torque threshold), and a high flow rate threshold associated with a high threshold RPM (e.g., a high rotational rate threshold) and/or torque (e.g., a high motor torque threshold) with stall or reduced performance of the downhole motor 126.

As discussed herein, the intervention system 100 may pump drilling fluid through the coiled tubing 110. The drilling fluid may be inserted at any point. For example, the drilling fluid may be inserted below the stripper 114. In some examples, the drilling fluid may be inserted at the wellhead 104. The drilling fluid may be mixed by retrieving an incompressible fluid for the incompressible portion from an incompressible fluid tank 132 and a compressible fluid for the compressible portion from a compressible fluid tank 134. The properties of the incompressible fluid (e.g., temperature, pressure, volumetric flow rate, mass flow rate) may be known or measured based on the pump used to pump the incompressible fluid into the coiled tubing system 102. The properties of the compressible fluid (e.g., temperature, pressure, volumetric flow rate, mass flow rate) may be known or measured based on the pump or injection system used to mix or inject the compressible fluid with the incompressible. For example, the intervention system 100 may include one or more sensors, such as temperature sensors, pressure sensors, flow rate sensors, scales, and so forth that may measure the properties of the compressible portion and the incompressible portion.

The BHA 124 may include one or more downhole temperature sensors 136 and downhole pressure sensors 138. Based on the temperature and pressure, a downhole motor control system may determine a composite flow rate of the drilling fluid at the BHA 124, which may be the composite flow rate of the drilling fluid through the downhole motor 126. Using the composite flow rate, the downhole motor control system may determine the RPM and the motor torque of the downhole motor 126. The downhole motor control system may then determine whether the RPM and/or the motor torque are within their respective threshold ranges, and adjust the incompressible flow rate and/or the compressible flow rate to return the RPM and/or the motor torque to within the threshold ranges. In this manner, the intervention system 100 may control the operation of the downhole motor 126 when using a drilling fluid having a combination of compressible and incompressible fluids. This may facilitate improved and/or more efficient operation of the downhole tools of the BHA 124.

Figure 2:
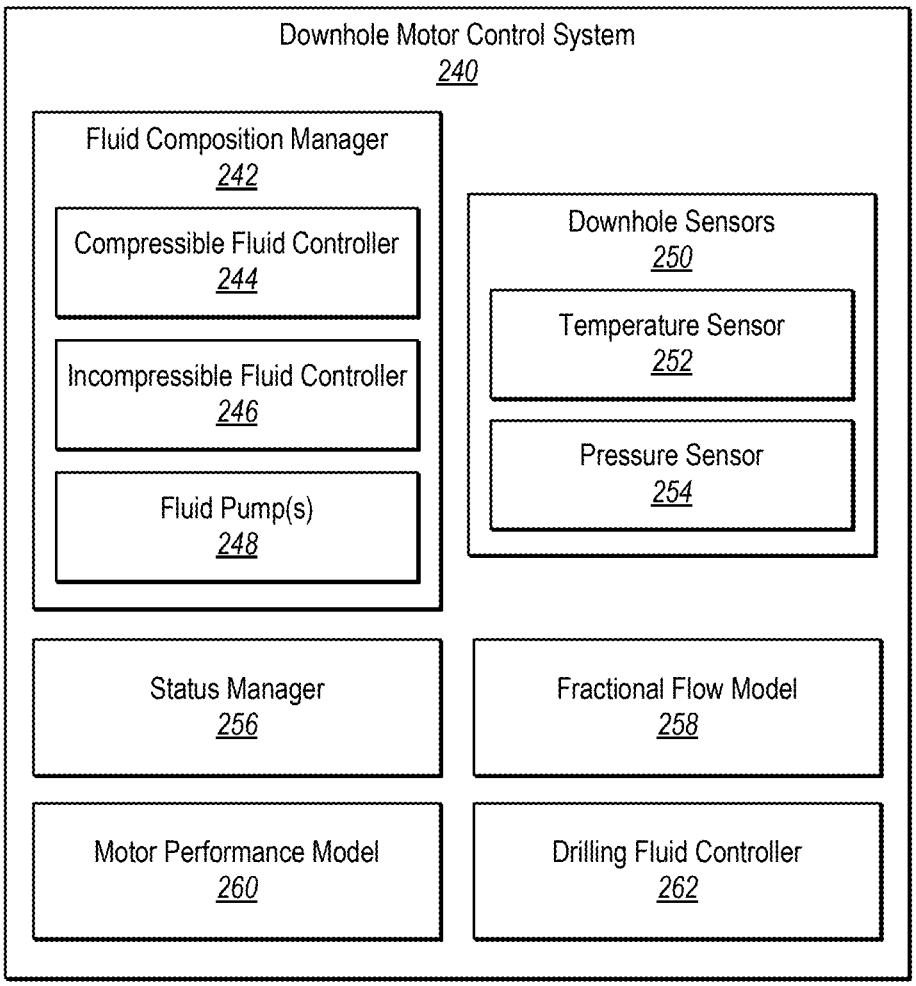
FIG. 2 is a representation of a downhole motor control system, according to at least one embodiment of the present disclosure.

FIG. 2 is a representation of a downhole motor control system 240, according to at least one embodiment of the present disclosure. Each of the components of the downhole motor control system 240 can include software, hardware, or both. For example, the components can include one or more instructions stored on a computer-readable storage medium and executable by processors of one or more computing devices, such as a client device or server device. When executed by the one or more processors, the computer-executable instructions of the downhole motor control system 240 can cause the computing device(s) to perform the methods described herein. Alternatively, the components can include hardware, such as a special-purpose processing device to perform a certain function or group of functions. Alternatively, the components of the downhole motor control system 240 can include a combination of computer-executable instructions and hardware.

Furthermore, the components of the downhole motor control system 240 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The downhole motor control system 240 may determine the effective flow rate or the composite flow rate of the drilling fluid at the downhole motor. In accordance with at least one embodiment of the present disclosure, the downhole composite flow rate of the drilling fluid at a particular depth may be determined using a combination of surface and downhole parameters. A fluid composition manager 242 may control the mixture of the compressible fluid and the incompressible fluid. For example, the fluid composition manager 242 may include a compressible fluid controller 244 and an incompressible fluid controller 246. The fluid composition manager 242 may determine the composition of the drilling fluid based on the wellbore conditions. The fluid composition manager 242 may adjust the flow rate of the incompressible and compressible components of the drilling fluid. For example, one or more fluid pumps may be controlled by the compressible fluid controller 244 and/or the incompressible fluid controller 246 to adjust the flow rate of the drilling fluid. The compressible fluid controller 244 may measure or infer properties of the compressible component, such as temperature, pressure, volumetric flow rate, surface compressible density, and mass flow rate. The incompressible fluid controller 246 may measure or infer properties of the incompressible component, such as temperature, pressure, volumetric flow rate, incompressible density, and mass flow rate.

The downhole motor control system 240 may include downhole sensors 250. The downhole sensors 250 may include a temperature sensor 252 and a pressure sensor 254. The downhole sensors 250 may be located at any location on the BHA. For example, the downhole sensors 250 may be located uphole (e.g., upstream with respect to the fluid flow) or downhole (e.g., downstream with respect to fluid flow) of the downhole motor.

Using the properties of the components of the drilling fluid, a status manager 256 may calculate or identify additional properties of the components of the drilling fluid. For example, the status manager 256 may calculate a downhole compressible density of the compressible component using downhole temperature measured by the temperature sensor 252 and the pressure measured by the pressure sensor 254. The downhole compressible density may be determined or calculated in any manner, such as using a real gas model. The real gas model may be any real gas model, such as the Redlich-Kwong model, the Berthelot model, the modified Berthelot model, the Dieterici model, the Clausius model, the Virial model, the Peng-Robinson model, the Wohl model, the Beattie-Bridgeman model, the Benedict-Webb-Rubin model, any other real gas model, and combinations thereof. As discussed herein, the surface compressible density of the compressible component may be known based on the conditions of the mixing chamber in which the compressible component and the incompressible component are mixed, or based on the conditions measured or inferred by the compressible fluid controller 244.

As discussed herein, the drilling fluid has an incompressible flow component, which is the portion of the total flow rate for which the incompressible portion of the drilling fluid is responsible. The drilling fluid has a compressible flow component, which is the portion of the total flow rate for which the compressible portion of the drilling fluid is responsible. As discussed herein, based on the compressibility of the compressible fluid, the compressible component of the total drilling fluid flow rate may change based on the difference between the surface compressible density and the downhole compressible density.

In accordance with at least one embodiment of the present disclosure, a fractional flow model 258 may determine incompressible fraction of the incompressible flow component of the composite flow rate based the incompressible fluid controller 246. The fractional flow model 258 may determine the compressible fraction of the compressible flow component of the total or composite flow rate based on the compressible density calculated by the status manager 256. In some embodiments, the fractional flow model 258 may determine a downhole compressible fraction of the downhole compressible flow component of the drilling fluid as it flows downhole based on the previously calculated downhole compressible density. The fractional flow model 258 may determine the downhole compressible fraction of the downhole compressible flow component $Q_{c\text{-}d}$ based on Eq. 1 and Eq. 2:

$$\rho_{c-d}Q_{c-d} = \rho_{c-s}Q_{c-s} \quad \text{Eq. 1}$$

$$Q_{c-d} = \frac{\rho_{c-s}Q_{c-s}}{\rho_{c-d}} \quad \text{Eq. 2}$$

where $\rho_{c-d}$ is the downhole compressible density, $\rho_{c-s}$ is the surface compressible density, and $Q_{c-s}$ is the surface compressible flow component. The fractional flow model 258 may determine the surface compressible flow component $Q_{c-s}$ through direct measurement prior to mixing and/or through inference and/or calculation based on conditions at mixing.

The fractional flow model 258 may calculate a downhole compressible fraction $f_{c-d}$ of the compressible flow component based on Eq. 3:

$$f_{c-d} = \frac{Q_{c-d}}{Q_{ic} + Q_{c-d}} \quad \text{Eq. 3}$$

where $Q_{ic}$ is the incompressible flow component. Using the downhole flow fraction, the fractional flow model 258 may calculate the downhole composite flow rate $Q_{comp}$ based on Eq. 4:

$$Q_{comp} = \frac{Q_{ic}}{1 - f_{c-d}} \quad \text{Eq. 4}$$

The fractional flow model 258 may further generate a drilling fluid composite density $\rho_{comp}$ for the downhole composite flow based on Eq. 5:

$$\rho_{comp} = f_{c-d} * \rho_{c-d} + (1 - f_{c-d}) * \rho_{ic} \quad \text{Eq. 4}$$

where $\rho_{ic}$ is the incompressible fluid density.

In accordance with at least one embodiment of the present disclosure, a motor performance model 260 may use the drilling fluid composite density and the composite flow rate to calculate or estimate the downhole motor torque and RPM. For example, the motor performance model 260 may utilize the performance diagrams for the downhole motor to determine the motor torque and the RPM. As discussed above, the downhole composite flow rate and the downhole composite density may be different than the surface flow rate and surface density. In this manner, the motor performance model 260 may calculate or determine motor torque and RPM that are representative of the actual conditions at the downhole motor.

A drilling fluid controller 262 may determine whether the motor torque and RPM are within a threshold range based on the properties of the downhole motor and/or the operating parameters of the downhole tools associated with, powered by, or receiving power indirectly from the downhole motor. If the drilling fluid controller 262 determines that the motor torque and RPM are outside of the threshold range, the fluid composition manager 242 may adjust the properties of the drilling fluid. For example, the fluid composition manager 242 may cause the compressible fluid controller 244 and/or the incompressible fluid controller 246 to adjust the composition of the drilling fluid. In some examples, the fluid composition manager 242 may cause the fluid pumps 248 to increase the flow rate of the compressible portion and/or the incompressible portion.

As a specific, non-limiting example, when the drilling fluid controller 262 determines that the motor torque is above a high torque threshold, the fluid composition manager 242 may cause the fluid pumps 248 to reduce the flow rate of the compressible portion and/or the incompressible portion. In some examples, the fluid composition manager 242 may cause the compressible fluid controller 244 and the incompressible fluid controller 246 to decrease the amount of the compressible fluid mixed with the incompressible fluid. These actions may reduce the motor torque.

As a specific, non-limiting example, when the drilling fluid controller 262 determines that the RPM is above a high RPM threshold, the fluid composition manager 242 may cause the fluid pumps 248 to reduce the flow rate of the compressible portion and/or the incompressible portion. In some examples, the fluid composition manager 242 may cause the compressible fluid controller 244 and the incompressible fluid controller 246 to decrease the amount of the compressible fluid mixed with the incompressible fluid. These actions may reduce the RPM.

As a specific, non-limiting example, when the drilling fluid controller 262 determines that the motor torque is below a low torque threshold, the fluid composition manager 242 may cause the fluid pumps 248 to increase the flow rate of the compressible portion and/or the incompressible portion. In some examples, the fluid composition manager 242 may cause the compressible fluid controller 244 and the incompressible fluid controller 246 to increase the amount of the compressible fluid mixed with the incompressible fluid. These actions may increase the motor torque.

As a specific, non-limiting example, when the drilling fluid controller 262 determines that the RPM is below a low RPM threshold, the fluid composition manager 242 may cause the fluid pumps 248 to increase the flow rate of the compressible portion and/or the incompressible portion. In some examples, the fluid composition manager 242 may cause the compressible fluid controller 244 and the incompressible fluid controller 246 to increase the amount of the compressible fluid mixed with the incompressible fluid. These actions may increase the RPM.

The drilling fluid controller 262 may identify when the motor torque is within a torque threshold range defined by the low torque threshold and the high torque threshold. In some embodiments, the drilling fluid controller 262 may identify when the RPM is within an RPM threshold range defined by the low RPM threshold and the high RPM threshold.

FIG. 3-6, the corresponding text, and the examples provide a number of different methods, systems, devices, and computer-readable media of the downhole motor control system 240. In addition to the foregoing, one or more embodiments can also be described in terms of flowcharts comprising acts for accomplishing a particular result, as shown in FIG. 3-6. FIG. 3-6 may be performed with more or fewer acts. Further, the acts may be performed in differing orders. Additionally, the acts described herein may be repeated or performed in parallel with one another or parallel with different instances of the same or similar acts.

Figure 3:
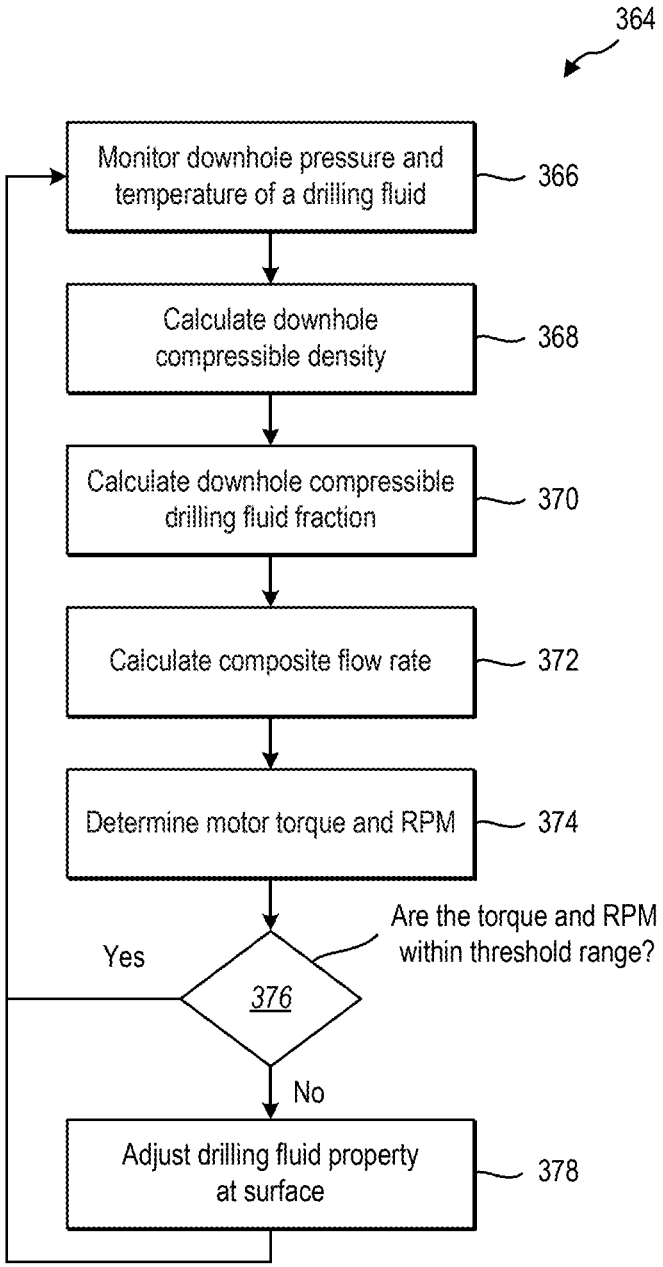
FIG. 3 is a flowchart of a method for identifying an output of a downhole motor, according to at least one embodiment of the present disclosure.

As mentioned, FIG. 3 illustrates a flowchart of a series of acts or a method 364 for identifying an output of a downhole motor, according to at least one embodiment of the present disclosure. While FIG. 3 illustrates acts according to one embodiment, alternative embodiments may omit, add to, reorder, and/or modify any of the acts shown in FIG. 3. The acts of FIG. 3 can be performed as part of a method. Alternatively, a computer-readable medium can comprise instructions that, when executed by one or more processors, cause a computing device to perform the acts of FIG. 3. In some embodiments, a system can perform the acts of FIG. 3.

A downhole motor control system may monitor the downhole pressure and temperature of a drilling fluid at 366. For example, a BHA, measuring while drilling (MWD), logging while drilling (LWD), or other downhole control system may measure the downhole pressure and temperature of the drilling fluid. The BHA may transmit the downhole pressure and temperature to the surface. For example, in a CT or wireline drilling environment, the CT tubing or wireline may include an electrical connection with the surface, and the downhole pressure and temperature may be transmitted to the surface over the electrical connection.

In some embodiments, using the downhole pressure and temperature, the downhole motor control system may calculate the downhole compressible density of the compressible portion of the drilling fluid at 368. Using the downhole compressible density, the surface compressible density, and the surface compressible flow component of the drilling fluid, the downhole motor control system may calculate the downhole compressible flow component of the drilling fluid. Using the downhole compressible flow component, the downhole motor control system may calculate the downhole compressible drilling fluid fraction at 370. This may then be used to calculate the composite flow rate of the drilling fluid at the downhole motor at 372. The downhole motor control system may calculate other downhole properties, including the composite density, which may be used to determine the motor torque and RPM of the downhole motor at 374.

In accordance with at least one embodiment of the present disclosure, the downhole motor control system may determine 376 whether the torque and RPM are within a threshold range. If the torque and RPM are within the threshold range, then the downhole motor control system may continue to monitor the downhole pressure and temperature and calculate the composite flow rate to determine the motor torque and RPM.

Specifically, the downhole motor control system may measure a second downhole temperature and a second downhole pressure at a second time after the first time. Using the second downhole pressure and the second downhole temperature, the downhole motor control system may calculate a second downhole compressible density of the compressible portion of the drilling fluid. Using the second downhole compressible density, the surface compressible density (which may be a second surface compressible density if it changed), and the surface compressible flow component (which may be a second surface compressible flow component if it changed) of the drilling fluid, the downhole motor control system may calculate a second downhole compressible flow component of the drilling fluid. Using the second downhole compressible flow component, the downhole motor control system may calculate a second downhole compressible drilling fluid fraction. This may then be used to calculate a second composite flow rate of the drilling fluid at the downhole motor. The downhole motor control system may calculate other downhole properties, including a second composite density, which may be used to determine a second motor torque and a second RPM of the downhole motor. The downhole motor control system may then determine 376 whether the second motor torque and the second RPM are within the threshold range. If they are within the threshold range, then the downhole motor control system may continue to monitor and calculate new values.

If the motor torque and/or RPM are outside of the threshold range, the downhole motor control system may adjust one or more drilling properties of the drilling fluid at the surface location at 378. For example, the downhole motor control system may adjust the fluid flow rate of the incompressible flow component. In some examples, the downhole motor control system may adjust the fluid flow rate or mass flow rate of the surface compressible flow component. In some examples, the downhole motor control system may adjust the pressure of the surface compressible portion of the fluid flow.

Figure 4:
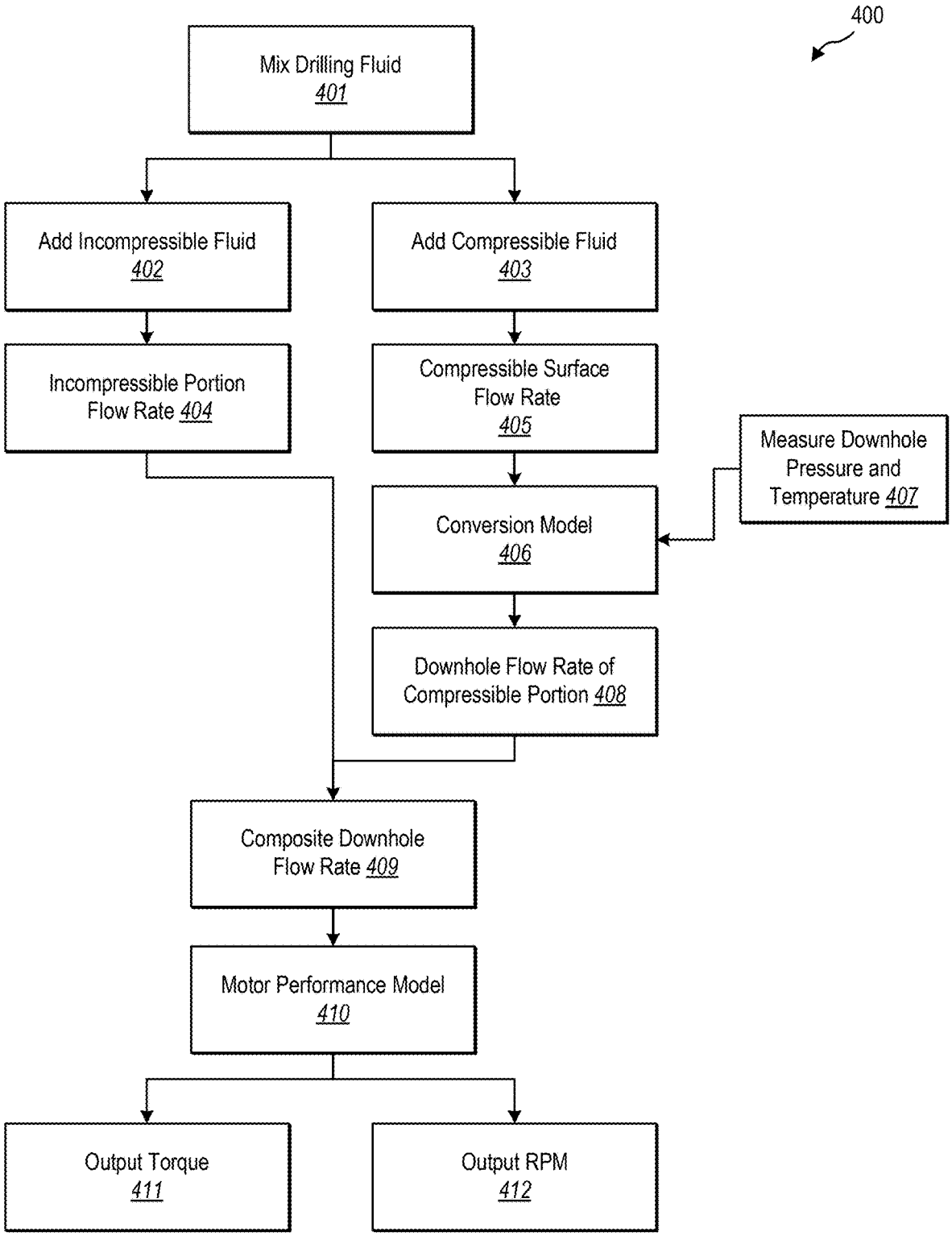
FIG. 4 is a flowchart of a method for identifying an output of a downhole motor, according to at least one embodiment of the present disclosure.

As mentioned, FIG. 4 illustrates a flowchart of a series of acts or a method 400 for identifying an output of a downhole motor, according to at least one embodiment of the present disclosure. While FIG. 4 illustrates acts according to one embodiment, alternative embodiments may omit, add to, reorder, and/or modify any of the acts shown in FIG. 4. The acts of FIG. 4 can be performed as part of a method. Alternatively, a computer-readable medium can comprise instructions that, when executed by one or more processors, cause a computing device to perform the acts of FIG. 4. In some embodiments, a system can perform the acts of FIG. 4.

The downhole motor control system 240 or an operator may mix a drilling fluid at 401. To mix the drilling fluid, the downhole motor control system 240 may add an incompressible fluid at 402 and add a compressible fluid at 403. The incompressible fluid may be added with an incompressible flow component, or an incompressible portion flow rate, at 404. Because the incompressible fluid is incompressible, the incompressible flow component may be the same at the surface location as downhole. The compressible fluid may be added with a surface compressible flow component, or a compressible surface flow rate, at 405.

Using the properties of the drilling fluid, a conversion model 406 may convert measured downhole pressure and temperature 407 to a downhole compressible flow component, or a downhole flow rate of the compressible portion 408. As discussed herein, the conversion model 406 may include any model, such as the status manager 256 and/or fractional flow model 258 of FIG. 2.

The downhole motor control system 240 may determine, using the incompressible flow component and the downhole compressible flow component, a composite downhole flow rate 409 of the drilling fluid. A motor performance model 410 may utilize the composite downhole flow rate, and other associated parameters as discussed herein, to determine an output torque 411 and an output RPM 412 of the downhole motor.

Figure 5:
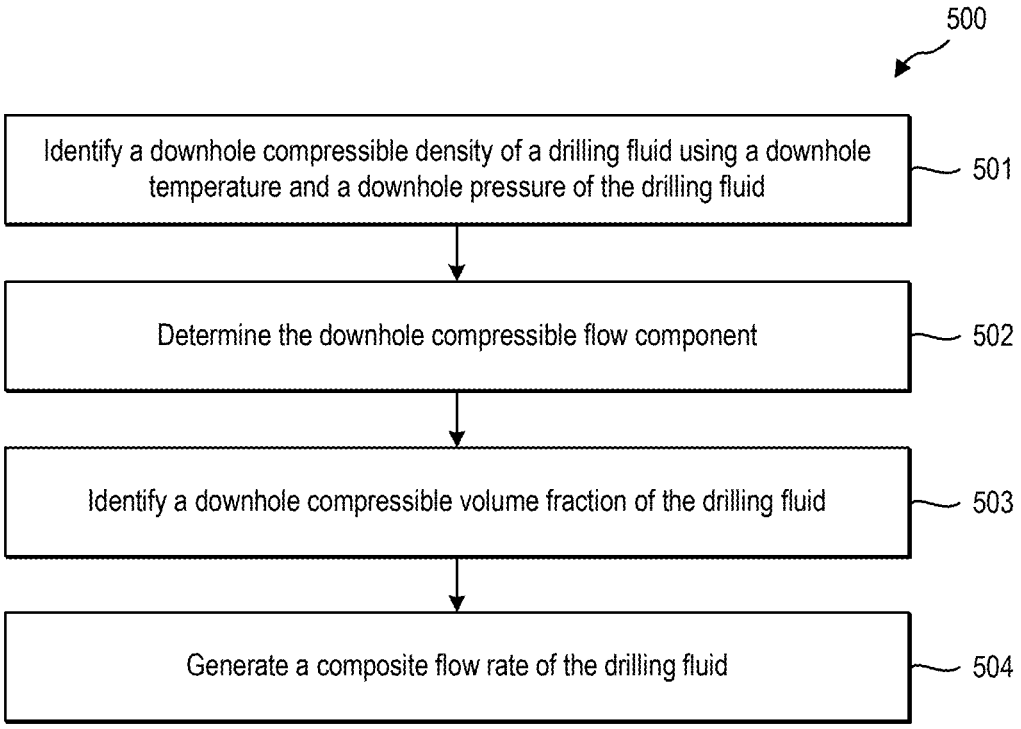
FIG. 5 is a flowchart of a method for identifying an output of a downhole motor, according to at least one embodiment of the present disclosure.

As mentioned, FIG. 5 illustrates a flowchart of a series of acts or a method 500 for identifying an output of a downhole motor, according to at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method. Alternatively, a computer-readable medium can comprise instructions that, when executed by one or more processors, cause a computing device to perform the acts of FIG. 5. In some embodiments, a system can perform the acts of FIG. 5.

The downhole motor control system may identify a downhole compressible density of a drilling fluid using a downhole temperature and a downhole pressure of the drilling fluid at 501. As discussed herein, the drilling fluid includes an incompressible portion and a compressible portion. The drilling fluid flows downhole hole with a compressible flow component and an incompressible flow component.

The downhole motor control system may determine the downhole compressible flow component using the downhole compressible density, a surface compressible density of the compressible portion at a surface location, and a surface compressible flow component of the compressible portion at the surface location at 502. The downhole motor control system may identify a downhole compressible volume fraction of the drilling fluid based on the downhole compressible flow component and the incompressible flow component at 503. The downhole motor control system may generate a composite flow rate of the drilling fluid based on the incompressible flow component and the downhole compressible volume fraction at 504.

As discussed in further detail herein, the downhole motor control system may further generate a drilling fluid composite density based on the downhole compressible density, an incompressible density of the incompressible component, and the downhole compressible volume fraction. The downhole motor control system may use the composite flow rate and the drilling fluid composite density to generate a downhole motor torque and rotational rate (e.g., RPM). The downhole motor control system may, based on the determined downhole motor torque and rotational rate, adjust the properties of the drilling fluid, as discussed in further detail herein.

Figure 6:
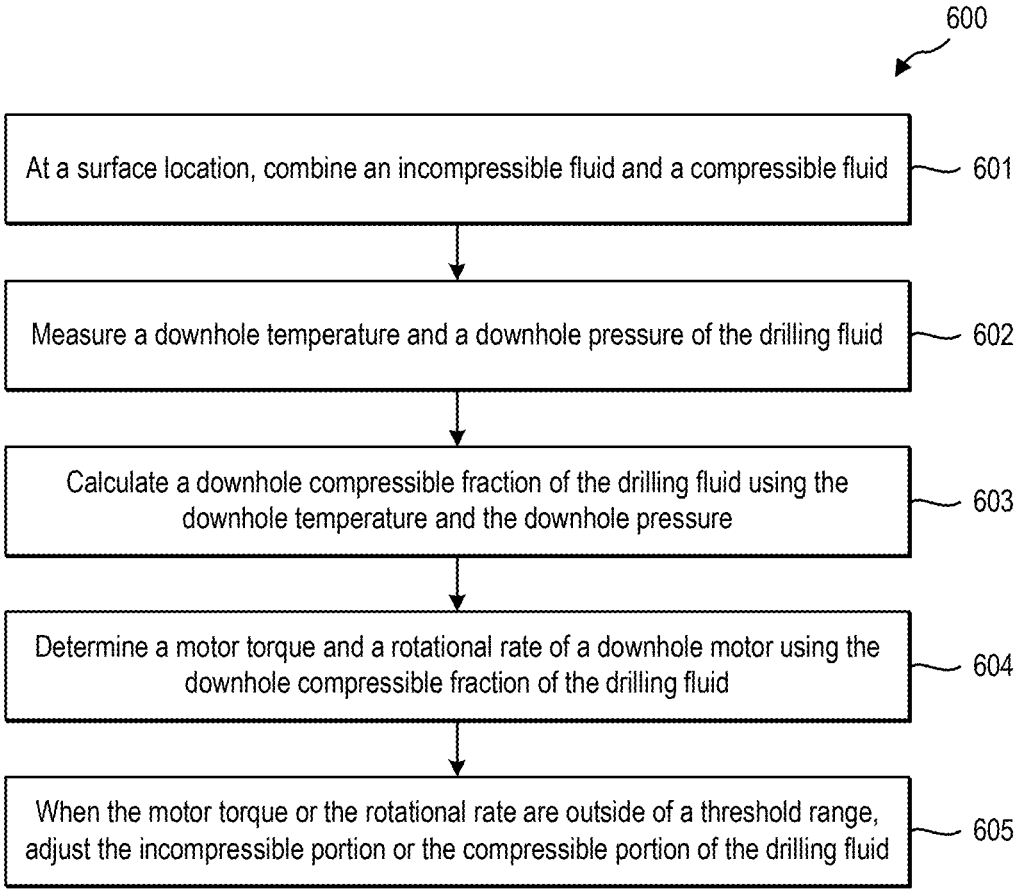
FIG. 6 is a flowchart of a method for identifying an output of a downhole motor, according to at least one embodiment of the present disclosure.

As mentioned, FIG. 6 illustrates a flowchart of a series of acts or a method 600 for identifying an output of a downhole motor, according to at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

The downhole motor control system may cause surface drilling equipment or surface pumping equipment to, at a surface location, combine an incompressible fluid and a compressible fluid at 601. Combining, or causing the surface pumping equipment to combine, the incompressible fluid and the compressible fluid results in a drilling fluid having an incompressible portion and a compressible portion. The compressible portion has a surface compressible density and a surface compressible flow component.

The downhole motor control system may measure, or cause downhole temperature sensors to measure, a downhole temperature and a downhole pressure of the drilling fluid at 602. The downhole motor control system may calculate a downhole compressible fraction of the drilling fluid using the downhole temperature and the downhole pressure at 603. The downhole motor control system may determine a motor torque and a rotational rate of a downhole motor using the downhole compressible fraction of the drilling fluid at 604. The downhole motor control system may, when the motor torque or the rotational rate are outside of a threshold range, adjust the incompressible portion or the compressible portion of the drilling fluid at 605. In some embodiments, when the motor torque and the rotational rate are within the threshold range, the downhole motor control system may maintain the incompressible portion and the compressible portion, or may maintain the relative ratios and flow components of the drilling fluid.

In accordance with at least one embodiment of the present disclosure, the downhole motor control system may be at least partially downhole, or at least a portion of the measurements and calculations may occur downhole at the BHA or at the downhole motor. The BHA may transmit the information collected and/or measured to the surface. For example, the BHA may transmit the measured downhole temperature and the measured downhole pressure to the surface. The BHA may transmit information to the surface in any manner. For example, the BHA may transmit the information to the surface using a wired connection, electromagnetic communication, mud pulse telemetry, any other communication mechanism, and combinations thereof.

In some embodiments, the BHA may communicate information to the surface in real-time. For example, the BHA may transmit information to the surface as it is measured, or after being cached in downhole memory for a brief period. Real-time communication and calculation may be communication or calculations that occur after a delay period of less than 1 s, less than 0.5 s, less than 0.1 s, less than 0.01 s, and any value therebetween.

As discussed herein, the determination of motor torque and rotational rate may be performed in a loop, or may be continuously monitored. For example, the downhole temperature may be a first downhole temperature, the downhole pressure may be a first downhole pressure, and the downhole motor control system may measure a second downhole temperature and a second downhole pressure. The downhole motor control system may calculate a second downhole compressible fraction of the drilling fluid using the second downhole temperature and the second downhole pressure. The downhole motor control system may determine a second motor torque and a second rotational rate of the downhole motor using the second downhole compressible fraction of the drilling fluid. The downhole motor control system may then determine whether the second motor torque and the second rotational rate are within the threshold range, and either maintain or adjust the incompressible portion and the compressible portion accordingly.

In accordance with at least one embodiment of the present disclosure, the downhole motor control system may be utilized to help design or adjust the equipment of the BHA. For example, the downhole motor control system may be used with a simulated CT system or other intervention system. The measured pressure and temperature may be estimated representations based on expected downhole conditions, or previously measured downhole conditions. The downhole motor control system may recommend an equipment type of the downhole motor based on the estimated motor torque and estimated rotational rate. For example, the downhole motor control system may recommend a new equipment type of the downhole motor and/or recommend a change in equipment type of the downhole motor.

Figure 7:
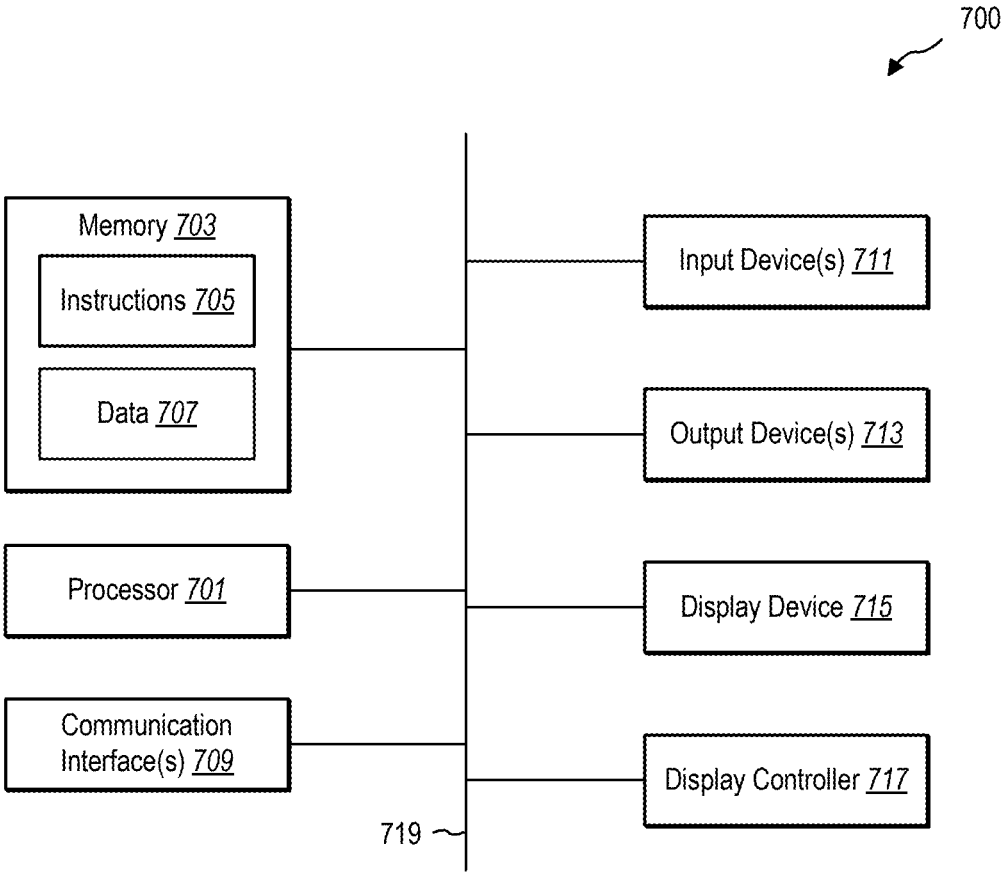
FIG. 7 is a representation of a computing system, according to at least one embodiment of the present disclosure.

FIG. 7 illustrates certain components that may be included within a computer system 700. One or more computer systems 700 may be used to implement the various devices, components, and systems described herein.

The computer system 700 includes a processor 701. The processor 701 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used.

The computer system 700 also includes memory 703 in electronic communication with the processor 701. The memory 703 may be any electronic component capable of storing electronic information. For example, the memory 703 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

The embodiments of the downhole motor control system have been primarily described with reference to wellbore drilling operations; the downhole motor control system described herein may be used in applications other than the drilling of a wellbore. In other embodiments, downhole motor control systems according to the present disclosure may be used outside a wellbore or other downhole environment used for the exploration or production of natural resources. For instance, downhole motor control systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for identifying an output of a downhole motor, comprising:

at a surface location, combining an incompressible fluid and a compressible fluid, resulting in a drilling fluid having an incompressible portion including the incompressible fluid and a compressible portion including the compressible fluid, the compressible portion having a surface compressible density and a surface compressible flow component;

measuring a downhole temperature and a downhole pressure of the drilling fluid;

calculating a downhole compressible fraction of the drilling fluid using the downhole temperature and the downhole pressure;

determining a motor torque and a rotational rate of a downhole motor using the downhole compressible fraction of the drilling fluid;

recommending an equipment type based on the motor torque and the rotational rate; and when the motor torque or the rotational rate is outside of a threshold range, adjusting the incompressible portion or the compressible portion of the drilling fluid.

2. The method of claim 1, further comprising transmitting the downhole temperature and the downhole pressure to a surface location.

3. The method of claim 2, wherein transmitting the downhole temperature and the downhole pressure includes transmitting in real-time.

4. The method of claim 1, wherein, when the motor torque and the rotational rate are within the threshold range, maintaining the incompressible portion and the compressible portion of the drilling fluid.

5. The method of claim 1, wherein the downhole temperature is a first downhole temperature and the downhole pressure is a first downhole pressure, and further comprising:

measuring a second downhole temperature and a second downhole pressure of the drilling fluid;

calculating a second downhole compressible fraction of the drilling fluid using the second downhole temperature and the second downhole pressure; and determining a second motor torque and a second rotational rate of the downhole motor using the second downhole compressible fraction of the drilling fluid.

6. The method of claim 5, further comprising, when the second motor torque or the second rotational rate are outside the threshold range, adjusting the incompressible portion or the compressible portion of the drilling fluid.

7. The method of claim 1, wherein, when the motor torque or the rotational rate is above a high threshold, adjusting the incompressible portion or the compressible portion includes reducing the incompressible portion or the compressible portion.

8. A system for identifying an output of a downhole motor, comprising:

a processor; and a memory in electronic communication with the processor, the memory including instructions that cause the processor to:

at a surface location, cause drilling equipment to combine an incompressible fluid and a compressible fluid, resulting in a drilling fluid having an incompressible portion of the incompressible fluid and a compressible portion of the compressible fluid, the compressible fluid having a surface compressible density and a surface compressible flow component;

measure a downhole temperature and a downhole pressure of the drilling fluid;

calculate a downhole compressible fraction of the drilling fluid using the downhole temperature and the downhole pressure;

determine a motor torque and a rotational rate of a downhole motor using the downhole compressible fraction of the drilling fluid;

recommend an equipment type based on the motor torque and the rotational rate; and when the motor torque or the rotational rate is outside of a threshold range, adjust the incompressible portion or the compressible portion of the drilling fluid.

9. The system of claim 8, wherein, when the motor torque or the rotational rate is above a high threshold, adjusting the incompressible portion or the compressible portion includes reducing the incompressible portion or the compressible portion.

* * * * *